US008899127B2

(12) United States Patent
Du et al.

(10) Patent No.: US 8,899,127 B2
(45) Date of Patent: Dec. 2, 2014

(54) SAFETY TRIGGER MECHANISM AND FUNCTIONAL FRAME FOR MOTION FURNITURE

(75) Inventors: Guoliang Du, Shanghai (CN); Paul L. Chen, Shanghai (CN); Jianjun Hu, Hangzhou (CN); Benny Mack Owens, New Albany, MS (US)

(73) Assignee: Shanghai Industries Group, Ltd., Shanghai (CN)

( * ) Notice: Subject to any disclaimer, the term of this patent is extended or adjusted under 35 U.S.C. 154(b) by 853 days.

(21) Appl. No.: 13/078,053

(22) Filed: Apr. 1, 2011

(65) Prior Publication Data

US 2012/0096975 A1 Apr. 26, 2012

(30) Foreign Application Priority Data

Oct. 21, 2010 (CN) ..... 2010 2 0571698 U

(51) Int. Cl.
*G05G 1/00* (2008.04)
*A47C 1/02* (2006.01)

(52) U.S. Cl.
CPC ..... *A47C 1/02* (2013.01)
USPC ..... 74/491; 297/41

(58) Field of Classification Search
USPC ..... 74/491; 297/20, 41, 103, 141, 71, 297/260.2, 271.3, 85, 423.3, 69
See application file for complete search history.

(56) References Cited

U.S. PATENT DOCUMENTS 3,410,600 A * 11/1968 Thorpe ..... 296/66
4,470,629 A * 9/1984 Collins, Jr. ..... 297/64
4,765,682 A * 8/1988 Satoh ..... 297/378.13
4,840,427 A * 6/1989 Hong ..... 297/344.14
5,137,328 A * 8/1992 Smith et al. ..... 297/85 C
6,715,825 B2 * 4/2004 Tame ..... 297/94
6,769,734 B2 * 8/2004 Tacker ..... 297/61
7,066,549 B2 * 6/2006 Dennon et al. ..... 297/440.2
7,338,132 B2 * 3/2008 LaPointe ..... 297/423.26
7,644,982 B2 * 1/2010 Paluch ..... 297/95
7,850,232 B2 * 12/2010 Casteel ..... 297/85 L
8,061,766 B2 * 11/2011 Miller ..... 297/60
8,366,188 B2 * 2/2013 Adams et al. ..... 297/85 R
2008/0012394 A1 * 1/2008 LaPointe ..... 297/20
2010/0052395 A1 * 3/2010 Anglese ..... 297/423.3
2011/0049954 A1 * 3/2011 Watanabe ..... 297/344.1

* cited by examiner

*Primary Examiner* — Troy Chambers
*Assistant Examiner* — Zakaria Elahmadi
(74) *Attorney, Agent, or Firm* — Dickinson Wright PLLC

(57) ABSTRACT

The present invention discloses a safety trigger mechanism and functional frame for motion furniture for driving a drive mechanism of motion furniture. The safety trigger mechanism includes a mounting board, and a pull wire, a fork and a first restoring spring connected in turn. The fork is mounted turnably about a first rivet on the mounting board by the first rivet, and a bent hook is disposed on one end of the fork and interlocked with a driving arm of the drive mechanism. The safety trigger mechanism further includes a safety hook with a notch, which is mounted turnably about a second rivet on the mounting board by the second rivet. One side edge of the safety hook abuts against the bent hook of the fork, and the driving arm has an arresting pin disposed thereon. The initial position of the arresting pin is in the notch of the safety hook, and the arresting pin is detached from the notch of the safety hook when the safety hook turns clockwise. Since the arresting pin of the driving arm is hooked by the safety hook to ensure that the drive mechanism cannot be unfolded, the present invention has more safety. Even if a large external force acts on the driving arm, the drive mechanism won't unfold itself.

5 Claims, 5 Drawing Sheets

SAFETY TRIGGER MECHANISM AND FUNCTIONAL FRAME FOR MOTION FURNITURE

CROSS REFERENCE TO RELATED APPLICATION

This present patent application is related to and claims the benefit of Chinese patent application No. 201020571698.X, titled "Safety Trigger Mechanism", filed Oct. 21, 2010. The whole content and disclosure of the abovementioned related application is expressly incorporated by reference herein as if fully set forth herein.

BACKGROUND OF THE INVENTION

1. Field of the Invention

The present invention relates to a trigger mechanism and functional frame for motion furniture, and more particularly to a safety trigger mechanism for unfolding a drive mechanism of motion furniture and functional frame for motion furniture therewith with higher safety.

2. Description of Related Art

Refer to FIGS. 1-5, a conventional trigger mechanism, for releasing a locked drive mechanism 13 of motion furniture which is shown in FIG. 2 and FIG. 3, mainly includes a fork 3, a pull wire 1, a first restoring spring 4 and a mounting board 2. As shown in FIGS. 3-5, the operating principle of the conventional trigger mechanism is explained as follows: in FIG. 3, since a driving arm 9 cannot turn clockwise in the limit of a limiting rivet 21 mounted on the driving arm 9 after the drive mechanism 13 is mounted, rotating points A, B, C of the driving arm 9 and a push rod 20 of the drive mechanism 13 are designed on one line, and the point A is over the balance point, wherein the balance point is below the point A and the vertical distance between the point A and the balance point is 3-4 mm as experience, and the mechanism is in a locked state under the action of the driving spring 7 because the force produced by the driving spring 7 has an upward component force F1 and the driving arm 9 cannot turn clockwise being stopped by the limiting rivet 21. When it needs to unfold the drive mechanism 13, the conventional trigger mechanism is pulled left by the pull wire 1, in the direction of the pulling force F2 as shown in FIG. 1, so the fork 3 turns anticlockwise about the first rivet 5 (referring to FIG. 1) and its bent edge pushes the upper edge of the driving arm 9 so that the driving arm 9 turns anticlockwise about the square shaft B (as shown in FIG. 4) and overcomes the upward component force F1 from the driving spring 7 until the point A is over the balance point, as shown in FIG. 4 At this time, the push rod 20 of the drive mechanism 13 pushes the connecting rod 8 to turn anticlockwise and the drive mechanism 13 begins to unfold. Finally, the drive mechanism 13 is fully unfolded, as shown in FIG. 5.

However, the conventional trigger mechanism has the shortcomings as follows: the pulling force of the pull wire 1 must be large enough to overcome the upward component force F1 of the driving spring 7, and only when the point A is kept in the balance position, the pulling force is very small or there is almost no pulling force, however, in this situation, the drive mechanism is easy to unfold itself, which will hurt users, especially children.

SUMMARY OF THE INVENTION

An object of the present invention is to provide a safety trigger mechanism and functional frame for motion furniture which can avoid that a drive mechanism of motion furniture unfolds itself when a pull force of a pull wire is small.

To achieve the above-mentioned object, a safety trigger mechanism for driving a drive mechanism of motion furniture in accordance with the present invention is provided.

The safety trigger mechanism includes a mounting board and a pull wire, a fork, a first restoring spring connected in turn, and the fork is mounted on the mounting board by a first rivet and may rotatable around the first rivet, a bent hook is disposed on one end of the fork and interlocked with a driving arm of the drive mechanism. The mechanism further includes a safety hook with a notch which is mounted on the mounting board by a second rivet and may rotatable around the second rivet. One side edge of the safety hook abuts against the bent hook of the fork, the driving arm has an arresting pin disposed thereon of which an initial position is in the notch of the safety hook, and the arresting pin is detached from the notch of the safety hook when the safety hook turns clockwise.

Correspondingly, a safety functional frame for motion furniture includes a main frame and a drive mechanism and a trigger mechanism mounted on the main frame. The drive mechanism includes a driving arm and a connecting-rod pushing mechanism of which a rotating point is disposed on the driving arm. A trigger mechanism includes a safety hook, the driving arm has an arresting pin disposed thereon; and an initial position of the arresting pin is determined by the safety hook and the arresting pin is detached from the safety hook when the safety hook is triggered to turn, and the rotating point is located at a balance point for triggering the drive mechanism.

The efficacy of the present invention is as follows: a: the force acting on the pull wire 1 connected with buttons is smallest; b. the connecting rod of the drive mechanism of motion furniture drives the driving arm to turn anticlockwise via a push rod, and since the arresting pin of the driving arm is hooked by the safety hook so that the drive mechanism cannot be unfolded, the present invention has more safety, and even if a large external force acts on the driving arm, the drive mechanism won't unfold itself.

DETAILED DESCRIPTION OF THE PREFERRED EMBODIMENTS

Figure 8:
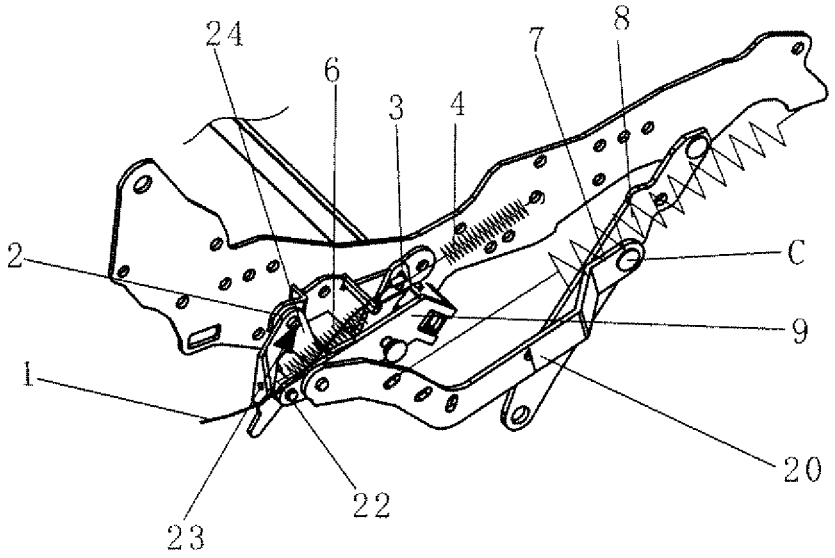
FIG. 8 is a schematic view of a functional frame for motion furniture with the safety trigger mechanism according to the present invention, in an unfolded state.

Firstly, refer to FIG. 8, a functional frame for motion furniture with a safety trigger mechanism in accordance with the present invention includes a main frame 211 and a drive mechanism and a trigger mechanism mounted on the main frame 211, wherein the drive mechanism includes a driving arm 9 and a connecting-rod pushing mechanism.

Figure 6:
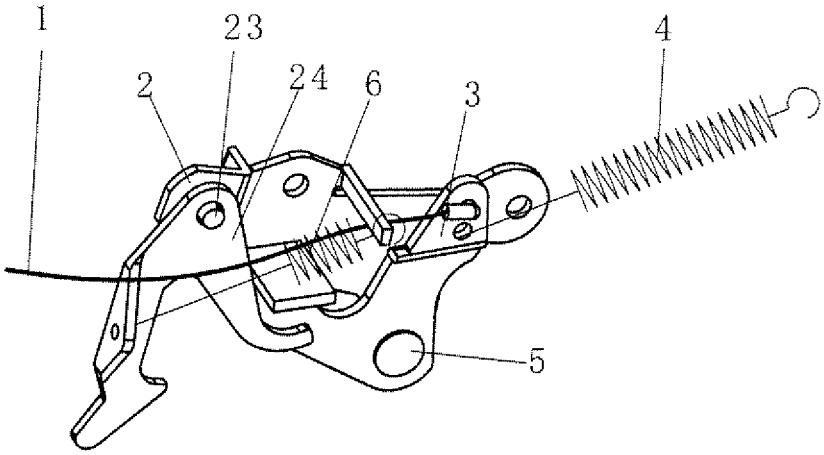
FIG. 6 is a schematic view of a safety trigger mechanism according to the present invention.

Refer to FIG. 6, a safety trigger mechanism in accordance to the present invention mainly includes a fork 3, a pull wire 1, a safety hook 24, a first restoring spring 4, a second restoring spring 6 and a mounting board 2. Alternatively, the safety trigger mechanism with the safety hook 24 is directly disposed on the main frame 211, without the mounting board 2. The safety trigger mechanism of the present invention has the structural feature that it has the safety hook 24, comparing with conventional trigger mechanisms.

Figure 1:
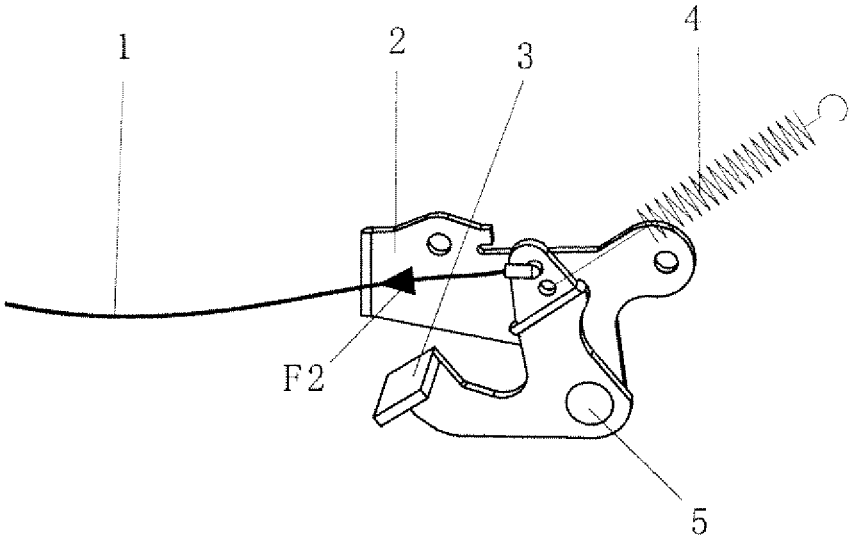
FIG. 1 is a schematic view of a conventional trigger mechanism.
Figure 2:
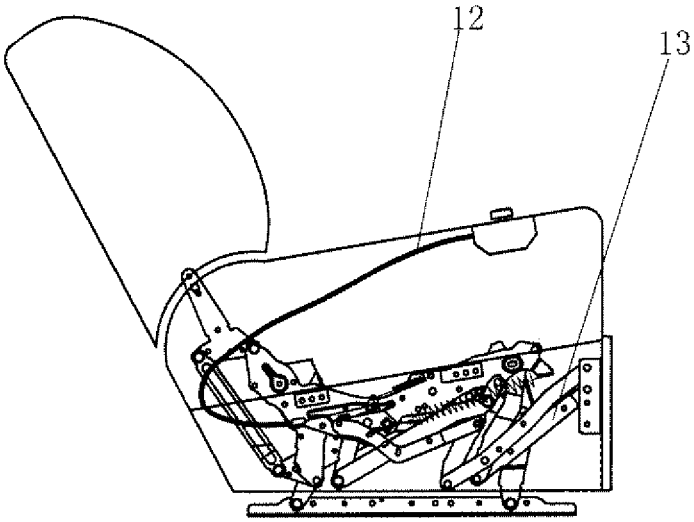
FIG. 2 is a schematic view of a functional frame for motion furniture with the conventional trigger mechanism.
Figure 3:
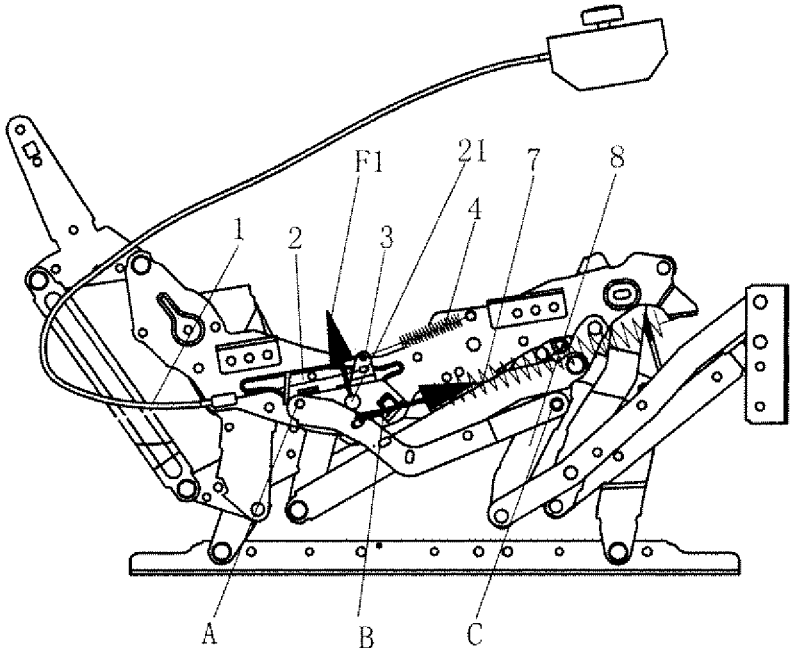
FIG. 3 is a schematic view showing a working principle of the conventional trigger mechanism.
Figure 4:
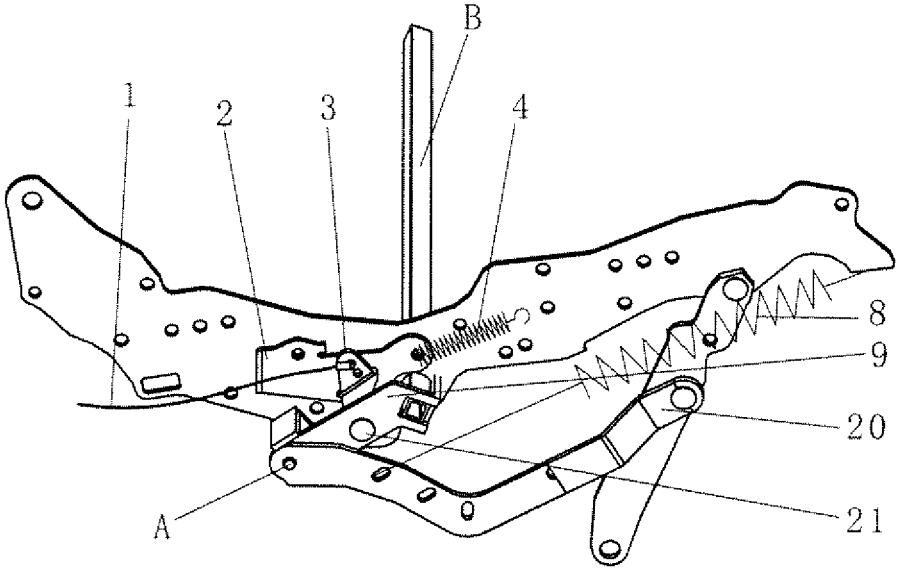
FIG. 4 is a schematic view of the functional frame for motion furniture with the conventional trigger mechanism, in an unfolded state.
Figure 5:
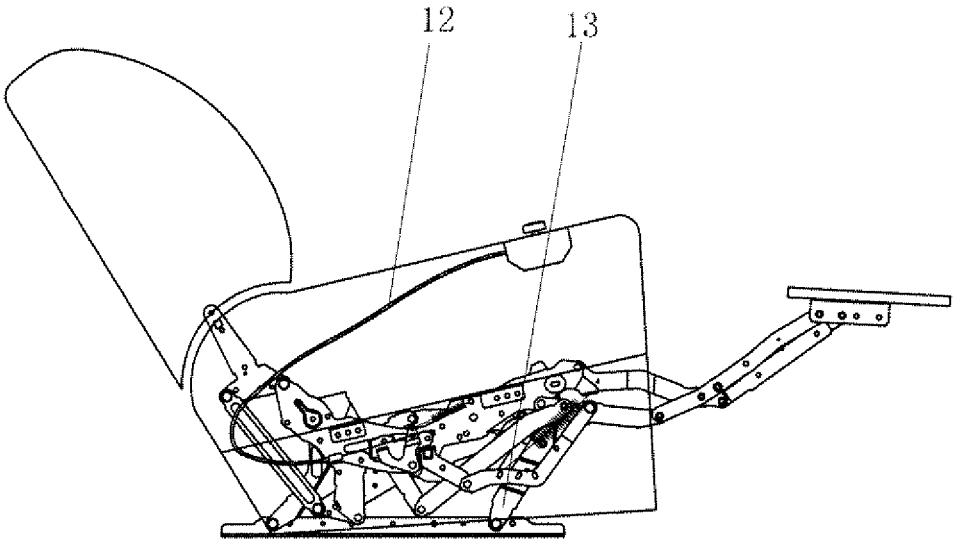
FIG. 5 is another schematic view of the functional frame for motion furniture with the conventional trigger mechanism, in an unfolded state.

In the present invention, the fork 3 generally has the same structure, position and installation method as forks of conventional trigger mechanisms. As shown in FIG. 1, FIG. 3, FIG. 4 and FIG. 6, the fork 3 and the mounting board 2 are riveted together with a first rivet 5 which serves as an axis and rotates freely in a hole of the fork 3 (the installation position and method is generally the same as shown in FIG. 1). One end of the first restoring spring 4 is hooked on the fork 3 and the other end thereof is hooked on a drive mechanism 13. The fixed end of the pull wire 1 is fixed on the drive mechanism 13 and the other end thereof is hooked in a hole of the fork 3, as shown in FIG. 3, so the length of the pull wire 1 is fixed. Since the pull wire 1 has the fixed length and the first restoring spring 4 produces a rightward pulling force, the position of the fork 3 is determined. The fork 3 has a bent hook 10 formed on one end thereof, which exerts a downward force on a driving arm 9 so that the drive mechanism 13 is unfolded when the fork 3 turns anticlockwise.

The safety hook 24 is generally shaped like an inverted V, wherein one edge of the safety hook 24 is an L-shaped hook edge, and the other edge thereof is a curved edge. An inverted V-shaped notch is defined between the two edges of the safety hook 24. A circular hole is formed in the cross portion between the two edges of the safety hook 24 for installation of a second rivet 23. Based on the engagement of the circular hole and the second rivet 23, the safety hook 24 can be fixed on the mounting board 2 and turn about the second rivet 23. The driving arm 9 has an arresting pin 22 disposed thereon and extending into the notch of the safety hook 24.

In FIG. 6, the second rivet 23 and the safety hook 24 are fastened together so that the second rivet 23 serves as an axis and rotates freely in the hole of the mounting board 2; or alternatively, the second rivet 23 and the mounting board 2 are fastened together and the safety hook 24 is freely rotatablely mounted on the second rivet 23 serving as an axis.

Figure 9:
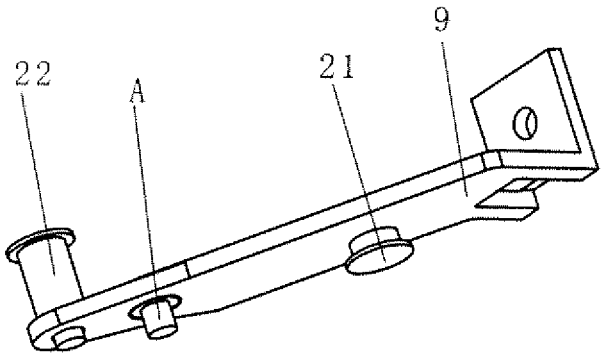
FIG. 9 is a structural schematic view of a driving arm according to the present invention.

The trigger mechanism further includes the second restoring spring 6 of which one end is hooked in a circular hole in the outer side of the L-shaped hook edge of the safety hook 24 and the other end is hooked on the mounting board 2. The safety hook 24 may turn anticlockwise under the action of the rightward force from the second restoring spring 6 until it is stopped by the fork 3 since the fork 3 is in a resting position. When the safety hook 24 is stopped by the fork 3, the curved edge of the safety hook 24 keeps being attached to one side of the bent hook of the fork 3 under the effect of the spring 6, and the L-shaped bent portion of the safety hook 24 must correspond to the position of the arresting pin 22, at this time, the L-shaped hook edge of the safety hook 24 just hooks and attaches to the arresting pin 22 of the driving arm 9. The structures of the driving arm 9 and the arresting pin 22 are shown in FIG. 9.

Figure 7:
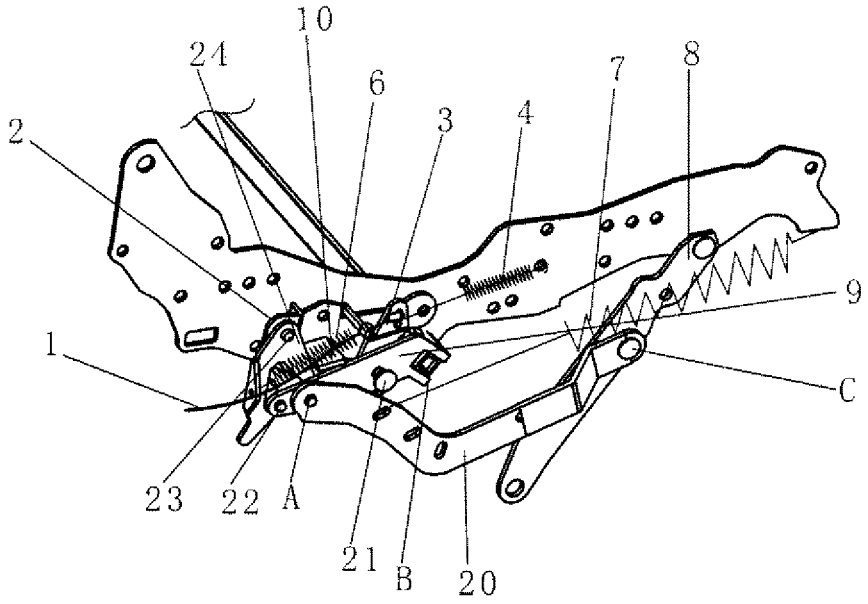
FIG. 7 is a schematic view showing a operating principle of the safety trigger mechanism according to the present invention.

As shown in FIG. 7, the working process of the safety trigger mechanism is as follows: when the pull wire 1 is pulled leftward, the fork 3 overcomes the resistance of the first restoring spring 4 and turns anticlockwise about the first rivet 5, and simultaneously, the bent hook 10 of the fork 3 pushes the safety hook 24 and makes it overcome the spring resistance and turn clockwise about the second rivet 23 until the arresting pin 22 is detached from the notch of the safety hook 24, so the safety hook 24 is released. As shown in FIG. 8, the fork 3 continues turning. Because the point A in FIG. 7 has already been at the balance point, the drive mechanism 13 will be unfolded instantaneously under the effect of the driving spring 7 in FIG. 3 and gravity if the fork 3 pushes the driving aim 9 slightly.

When the pull wire 1 is released, the fork 3 returns to its initial position under the action of the rightward force of the first restoring spring 4 and the safety hook 24 returns to it initial position under the effect of the second restoring spring 6.

When the locked drive mechanism 13 is forced to unfold under impact and an external force, a connecting rod of the drive mechanism 13 drives the driving arm 9 to turn anticlockwise via a push rod 20. Since the arresting pin 22 of the driving arm 9 is hooked by the safety hook 24 to ensure that the drive mechanism 13 cannot be unfolded, the present invention has more safety.

The preferred embodiment of the present invention is disclosed above to ensure that those skilled in the art can use or utilize it. Those skilled in the art may make various modifications or variations depending on the preferred embodiment of the present invention without departing from the scope of the present invention. For example, the safety hook may also be an L-shaped hook with a hole, and as long as a safety hook has features of an L-shaped hook and a hole, it is in the scope of the present invention. It will be understood that what are disclosed above are only the specification and the drawings of the preferred embodiment of the present invention and various modification and variations made depending on the specification and the drawings of the present invention won't depart from the scope of the present invention.

What is claimed is:

1. A safety functional frame for motion furniture, comprising:

a main frame;

a drive mechanism, mounted on the main frame and including a driving arm and a connecting-rod pushing mechanism of which a rotating point is disposed on the driving arm, the driving arm having an arresting pin disposed thereon; and a trigger mechanism, mounted on the main frame and including a safety hook;

wherein an initial position of the arresting pin is determined by the safety hook, and the arresting pin is detached from the safety hook when the safety hook is triggered to turn, and the rotating point is located at a balance point for triggering the drive mechanisms;

wherein the trigger mechanism includes a fork which is mounted turnably about a first rivet on the main frame by the first rivet;

a bent hook is disposed on one end of the fork and interlocked with the driving arm of the drive mechanism;

the safety hook is mounted turnably about a second rivet on the main frame by the second rivet;

the safety hook is generally V-shaped, and a notch is formed between two side edges of the safety hook for fixing the arresting pin which is at the initial position;

one side edge of the safety hook is an L-shaped hook edge and the other side edge thereof is a curved edge;

the curved edge of the safety hook abuts against the bent hook of the fork.

2. The safety functional frame for motion furniture as claimed in claim 1, wherein the arresting pin and the L-shaped hook edge of the safety hook are engaged with each other, and the initial position of the arresting pin is in the bent portion of the L-shaped hook edge of the safety hook and the arresting pin is detached from the bent portion of the L-shaped hook edge of the safety hook when the safety hook turns clockwise to its final position.

3. The safety functional frame for motion furniture as claimed in claim 1, wherein a circular hole is formed in a cross portion between the two side edges of the safety hook for installation of the second rivet.

4. The safety functional frame for motion furniture as claimed in claim 1, wherein the second rivet and the safety hook are fastened together and the second rivet serves as an axis and rotates freely in a hole of the main frame.

5. The safety functional frame for motion furniture as claimed in claim 1, wherein the second rivet and the main frame are fastened together and the safety hook is freely rotatablely mounted on the second rivet serving as an axis.

* * * * *

UNITED STATES PATENT AND TRADEMARK OFFICE

CERTIFICATE OF CORRECTION

PATENT NO. : 8,899,127 B2
APPLICATION NO. : 13/078053
DATED : December 2, 2014
INVENTOR(S) : Guoliang Du et al.

It is certified that error appears in the above-identified patent and that said Letters Patent is hereby corrected as shown below:

In the Specification
Column 4, Line 11 “aim” should be --arm--.

In the Claims
Column 4, Line 53 “mechanisms” should be --mechanism--.

Signed and Sealed this
Tenth Day of March, 2015

Michelle K. Lee

Michelle K. Lee
*Deputy Director of the United States Patent and Trademark Office*